US010260795B2

(12) United States Patent
Giacomini et al.

(10) Patent No.: US 10,260,795 B2
(45) Date of Patent: Apr. 16, 2019

(54) REFRIGERATOR DOOR-AJAR SWITCH WITH DAMPING FUNCTION AND METHOD OF OPERATION

(71) Applicant: WHIRLPOOL CORPORATION, Benton Harbor, MI (US)

(72) Inventors: Neomar Giacomini, St. Joseph, MI (US); Axel Julio Ramm, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 314 days.

(21) Appl. No.: 14/729,167

(22) Filed: Jun. 3, 2015

(65) Prior Publication Data

US 2016/0356541 A1 Dec. 8, 2016

(51) Int. Cl.

*F25D 23/02* (2006.01)
*F25D 29/00* (2006.01)
*G08B 21/18* (2006.01)

(52) U.S. Cl.

CPC ..... *F25D 23/028* (2013.01); *F25D 29/008* (2013.01); *G08B 21/18* (2013.01); *F25D 2700/02* (2013.01)

(58) Field of Classification Search

CPC ..... E05F 5/06; E05F 15/06; F25D 17/045; F25D 23/028; F25D 23/062; F25D 23/066; F25D 29/00; F25D 2201/10; F25D 2600/00; F25D 2600/02; F25D 2700/02; F25D 2700/12; G08B 21/18

USPC ..... 16/185; 62/187; 340/545.6, 585

See application file for complete search history.

(56) References Cited

U.S. PATENT DOCUMENTS 1,530,964 A 3/1925 Weeks
2,209,868 A * 7/1940 Wolcott ..... H01H 21/282 200/339
2,780,198 A * 2/1957 Low ..... A47L 15/4293 116/215
3,004,127 A * 10/1961 Carding ..... H01H 1/50 200/16 A
3,246,939 A * 4/1966 Petkwitz ..... F25D 25/022 126/340
3,373,257 A * 3/1968 Matthias ..... H01H 3/60 200/288
3,979,357 A 9/1976 Salyer et al.
4,163,970 A 8/1979 Allinquant et al.
4,532,388 A 7/1985 Sackmann et al.
4,562,318 A * 12/1985 Sorenson ..... H01H 21/22 200/239
4,566,285 A 1/1986 Tershak et al.
4,707,684 A 11/1987 Janke et al.

(Continued)

*Primary Examiner* — Quan-Zhen Wang
*Assistant Examiner* — Stephen R Burgdorf
(74) *Attorney, Agent, or Firm* — Diederiks & Whitelaw, PLC.

(57) ABSTRACT

A refrigerator includes a cabinet, a door, a cooling system, an indicator configured to indicate a door-ajar condition and a door-ajar switch. The cabinet includes a liner that defines a refrigerated compartment, and the door is movable between an open position and a fully closed position to selectively seal the refrigerated compartment. The cooling system is configured to generate cool air and circulate the cool air within the refrigerator. The door-ajar switch includes a switch portion and a damper portion, with the portions located adjacent to one another in a common housing mounted to the cabinet or the door.

17 Claims, 3 Drawing Sheets

(56) References Cited

U.S. PATENT DOCUMENTS

| | | | | |
|---|---|---|---|---|
| 4,835,905 | A | 6/1989 | Lasier et al. | |
| 5,003,136 | A | 3/1991 | Valenzona | |
| 5,027,473 | A | 7/1991 | Hottmann | |
| 5,070,319 | A | 12/1991 | Scuka | |
| 6,207,911 | B1 | 3/2001 | Hirsch et al. | |
| 7,005,983 | B2 | 2/2006 | Holmes et al. | |
| 8,225,458 | B1 * | 7/2012 | Hoffberg | E05F 3/102 16/49 |
| 8,373,524 | B1 * | 2/2013 | Villarin | H01H 1/225 335/78 |
| 8,474,100 | B2 | 7/2013 | Vanini | |
| 8,572,808 | B2 | 11/2013 | Bonomie et al. | |
| 9,004,325 | B2 * | 4/2015 | Licht | B67D 1/0857 222/477 |
| 2007/0284232 | A1 * | 12/2007 | Glasson | H01H 13/18 200/329 |
| 2008/0121501 | A1 | 5/2008 | Ahn | |
| 2010/0059351 | A1 * | 3/2010 | Wu | A47B 13/12 200/341 |

* cited by examiner

REFRIGERATOR DOOR-AJAR SWITCH WITH DAMPING FUNCTION AND METHOD OF OPERATION

BACKGROUND OF THE INVENTION

The present invention pertains to refrigerators and, more particularly, to a door-ajar switch for a refrigerator.

Typically, a refrigerator has a fresh food compartment and a freezer compartment, each compartment selectively sealed by a door mounted on a hinge. If either door remains open for a predetermined period a time, an audible or visual alarm is triggered to warn the user of this condition. This prevents a situation in which either: 1) an excessive amount of energy is required to maintain the relevant compartment at an appropriate temperature; or 2) the refrigerator is unable to maintain the relevant compartment at the appropriate temperature, thereby leading to spoilage of food located therein. In general, the predetermined period of time before the alarm is triggered is preferably sufficiently long so as not to annoy a user but sufficiently short that excessive energy use and undesirable temperature conditions are avoided.

Additionally, a refrigerator can include one or more dampers or a damping system, which absorb energy to reduce the speed at which the doors close in order to prevent the doors from slamming shut. Beyond providing an improved user experience, this also reduces mechanical stress on the components of the refrigerator. As the door-ajar and damping systems are usually provided as separate components of the refrigerator, the cost and complexity of manufacturing the refrigerator are increased. Also, from the perspective of the user, the overall visual impact of the distinct systems is increased.

SUMMARY OF THE INVENTION

The present invention is directed to a door-ajar switch for a refrigerator comprising a cabinet, a door, a cooling system and an indicator configured to indicate a door-ajar condition. The cabinet includes a liner that defines a refrigerated compartment, and the door is movable between an open position, wherein food items stored in the refrigerated compartment can be accessed, and a fully closed position, wherein the refrigerated compartment is sealed. The cooling system is configured to generate cool air and circulate the cool air within the refrigerator. The door-ajar switch includes a switch portion and a damper portion, preferably with the portions located adjacent to one another in a common housing mounted to the cabinet or the door.

In one embodiment, the switch portion has a first electrical contact and a second electrical contact, and the damper portion has a piston movable within a piston cylinder. In another embodiment, the door-ajar switch further includes an actuator configured to move between a first position, when not contacted by the door, and a second position, when contacted by the door and the door is in the fully closed position. The damper portion has a damper that contacts or is coupled to the actuator such that movement of the door between the open position and the fully closed position is dampened while the door is in contact with the actuator. Preferably, it is a piston rod of the damper that contacts or is coupled to the actuator. Additionally, the actuator is configured to open or close the door-ajar switch when the actuator moves between the first and second positions. The first and second electrical contacts of the switch portion are not in contact when the actuator is in one of the first and second positions, thereby opening the door-ajar switch.

However, the first and second electrical contacts are in contact when the actuator is in the other of the first and second positions, thereby closing the door-ajar switch. In still another embodiment, the door-ajar switch further includes a spring configured to bias the actuator to the first position.

In one preferred embodiment, the switch portion and the damper portion are located in a side-by-side arrangement. The actuator is configured to pivot between the first and second positions, with the actuator having a first end proximate to a pivot axis of the actuator and a second end distal to the pivot axis. The damper portion has a damper that contacts or is coupled to one end of the actuator. The other end of the actuator is configured to open or close the door-ajar switch when the actuator is pivoted between the first and second positions.

In another preferred embodiment, the housing has two sidewalls, with the switch portion being located proximate one of the sidewalls and the damper portion located proximate the other of the sidewalls. The damper portion includes a piston cylinder located within the housing, and the switch portion includes a first electrical contact coupled to the housing or located within the housing. The door-ajar switch further includes an actuator coupled to the housing, and the actuator has a second electrical contact. The first and second electrical contacts are brought into or out of contact as the door is moved to the fully closed position.

Additional objects, features and advantages of the present invention will become more readily apparent from the following detail description of preferred embodiments when taken in conjunction with the drawings wherein like reference numerals refer to corresponding parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
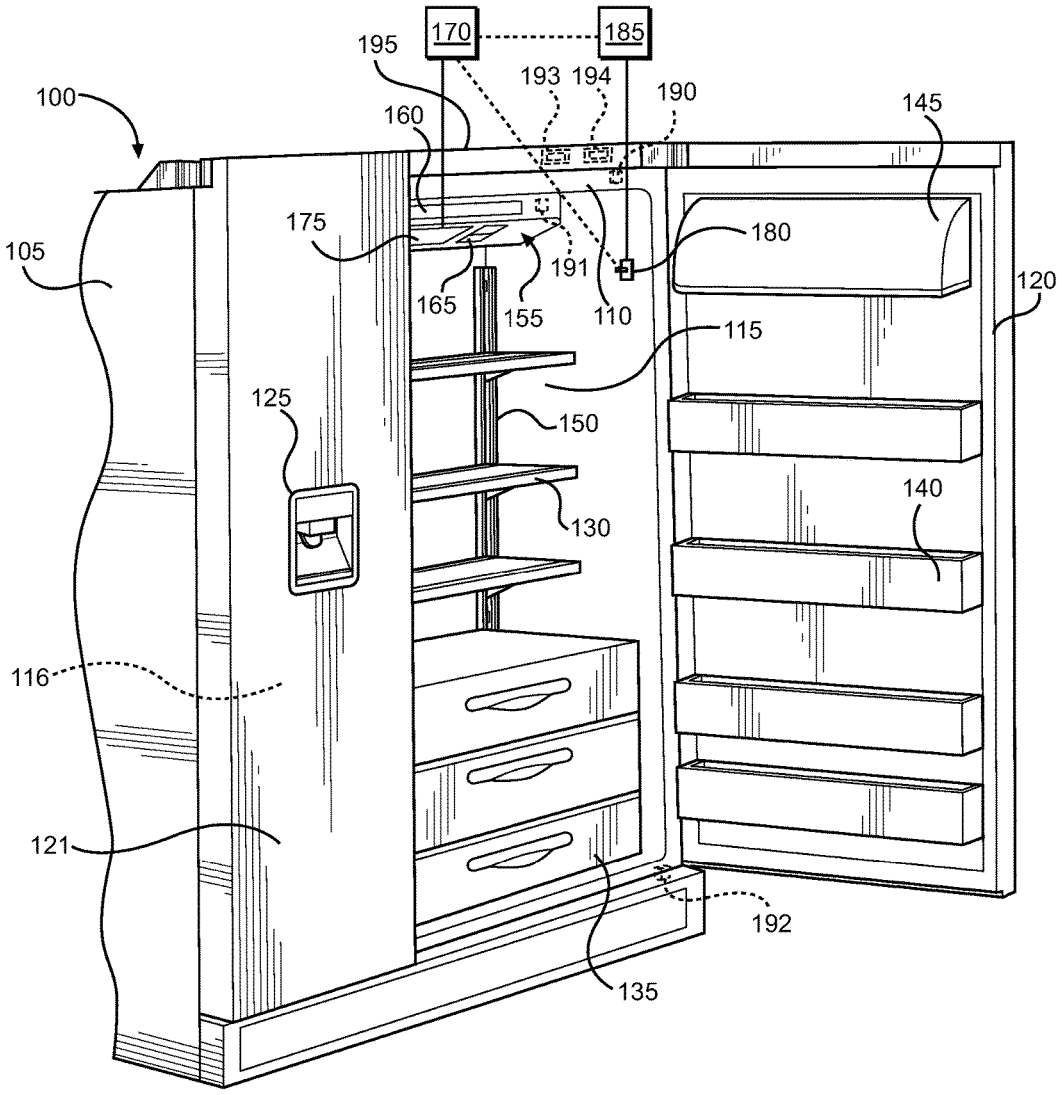
FIG. 1 is a perspective view of a refrigerator constructed in accordance with the present invention.

With initial reference to FIG. 1, there is illustrated a refrigerator 100 constructed in accordance with the present invention. Refrigerator 100 is shown in a side-by-side configuration, although the present invention can certainly be employed in other refrigerator configurations, e.g., French door, bottom-mount, top-mount and drawer style refrigerators. Refrigerator includes a cabinet (or outer shell) 105 within which is positioned a liner 110 that defines a fresh food compartment 115. Another liner (which is not visible this view) is also positioned in cabinet 105 to define a freezer compartment 116. Additionally, refrigerator 100 includes a fresh food door 120, which selectively seals fresh food compartment 115, and a freezer door 121, which selectively seals freezer compartment 116. In the embodiment shown, freezer door 121 includes a dispenser 125 for dispensing water or ice when desired by a user without the need for the user to access fresh food compartment 115 or freezer compartment 116. For completeness, refrigerator 100 is also shown to include a plurality of shelves (one of which is labeled 130), a plurality of drawers (one of which is labeled 135), a plurality of door bins (one of which is labeled 140) and a dairy compartment 145. Preferably, at least the shelves 130 and door bins 140 are vertically adjustable, with the shelves 130 being adjustable along a pair of ladder rails (one of which is labeled 150). In addition, one or more of the drawers 135 can be temperature or climate controlled, if desired. Although not shown, refrigerator 100 further includes a cooling (or refrigeration) system that establishes above and below freezing temperatures in compartments 115 and 116, respectively, by generating and then circulating cool air within refrigerator 100.

In the embodiment shown, a user interface (or temperature control housing) 155 is mounted in an upper region of fresh food compartment 115. However, user interface 155 can, of course, be located elsewhere in refrigerator 100. User interface 155 includes a display 160 and a plurality of control elements (generally indicated at 165). Control elements 165 can include, for example, temperature control elements for adjusting the temperature of fresh food compartment 115 and freezer compartment 116. User interface 155 also includes a controller (or control system) 170, which is operatively connected to various components of refrigerator 100, as well as a light 175, which turns on and off in response to contact between fresh food door 120 and a switch 180. In any event, the particular details of user interface 155 are known in the art, such as set forth in greater detail in U.S. Pat. No. 7,827,811, titled "Refrigerator Control Including a Hidden Features Menu", which is hereby incorporated by reference.

In addition to controlling light 175, switch 180 also functions as a door-ajar switch. As used in connection with the present invention, a door is "ajar" when it is slightly open (i.e., when it is almost but not quite fully closed such that the associated door is not sealed). However, door-ajar switch 180 can also provide an indication to the user when the door is in any open position from ajar to fully open. In any case, if fresh food door 120 remains open for a predetermined amount of time, it is desired to provide a warning to a user. In this regard, switch 180 sends a signal to an indicator 185, which is configured to indicate a door-ajar condition. Indicator 185 can either be separate from, linked to or incorporated into controller 170. In any case, indicator 185 constitutes part of a signaling circuit used to indicate to the user that the door is still open. This door-ajar indication can take a variety of forms, including an audible indicator (such as a buzzer), a visual indicator (such as one or more lights) or a combination thereof. Alternatively, if refrigerator 100 is part of a "smart home" system or connected to the internet, the door-ajar indication can be sent to a remote device, such as a user's phone. Such an indication should preferably be in addition to the audible or visual indication and can come after a further delay (e.g., a sound is emitted after fresh food door 120 is open for a first predetermined time period, such as thirty seconds, and a notification is sent to the user's phone after a second predetermined time period, such as another thirty-second delay, in case the user is no longer close enough to refrigerator 100 to hear the sound).

In FIG. 1, switch 180 is shown on a sidewall of fresh food compartment 115 nearest to the pivot axis of fresh food door 120. However, switch 180 can be provided at a variety of different locations, including those indicated by reference numerals 190-194. With respect to location 191, providing a switch on user interface 155 can be advantageous in that it eliminates the need to create an additional hole in liner 110 and reduces the amount of wiring necessary to transmit signals between the switch and light 175, for example. However, in such an arrangement, a portion of fresh food door 120 near dairy compartment 145 or dairy compartment 145 itself should be modified to ensure contact between fresh food door 120 and the switch (e.g., the portion of fresh food door 120 near the top of dairy compartment 145 can be modified so as to extend inwardly from fresh food door 120). With respect to locations 190 and 192, upper and lower portions of fresh food door 120 will contact switches provided at these locations during movement of fresh food door 120 to the fully closed position. With respect to locations 193 and 194, fresh food door 120 can be configured to contact a switch provided on an exterior housing 195 (which can house electronics and portions of the hinges for fresh food door 120 and freezer door 121, for example). When switch 180 is provided at the location shown in FIG. 1, either dairy compartment 145 or a dike portion of fresh food door 120 will contact switch 180 during movement of fresh food door 120 to the fully closed position. Certainly, these are a wide range of potential switch mounting and activation arrangements. Therefore, as used in connection with the present invention, when a door is described as contacting a switch, the term "door" includes: the door itself; any storage shelf, bin or compartment coupled to the door; and any trim or frame member extending inwardly from an interior face of the door. However, it should also be realized that switch 180 could be on door 120 itself for engagement with another portion of refrigerator 100 when door 120 is closed.

Figure 2:
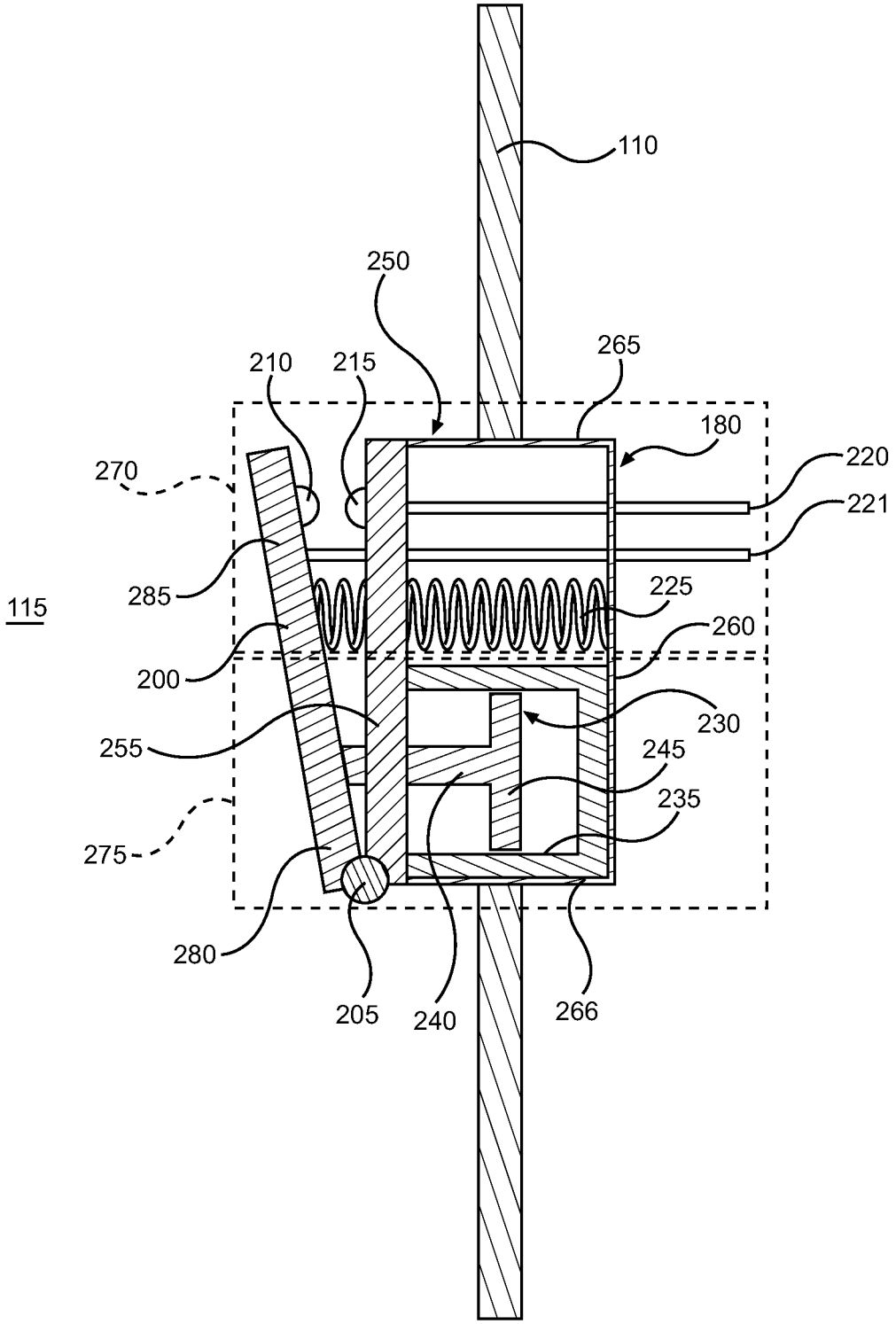
FIG. 2 is a cross section of a portion of the refrigerator showing a combined door-ajar switch and damper of a first embodiment.

Turning to FIG. 2, there is illustrated a cross section of a portion of refrigerator liner 110 showing switch 180 from a top-down perspective. In other words, the top of the page is nearer to the rear of refrigerator 100, the bottom of the page is nearer to the front of refrigerator 100 and the left side of the page represents fresh food compartment 115 which, as discussed above, is defined by liner 110. In this exemplary embodiment, switch 180 is mounted to refrigerator 100 such that at least an actuator 200 of switch 180 extends into fresh food compartment 115 where actuator 200 can be contacted by fresh food door 120. In FIG. 2, actuator 200 is shown in a first position, which is the position in which actuator 200 is located when fresh food door 120 is open or resting against actuator 200 (as in an ajar position). As fresh food door 120 is moved to the fully closed position, fresh food door 120 causes actuator 200 to pivot about a pivot axis defined by a hinge 205. Once fresh food door 120 is fully closed, actuator 200 reaches a second position (not shown) in which a first electrical contact 210 and a second electrical contact 215 touch one another, thereby closing switch 180 via wires 220 and 221. The closing of switch 180 indicates to refrigerator 100 (and, more specifically, to indicator 185 and/or controller 170) that fresh food door 120 is fully closed. Conversely, when switch 180 is open, this indicates that fresh food door 120 is at least partially open. In order to prevent first electrical contact 210 from touching second electrical contact 215 when fresh food door 120 is not in the fully closed position, a spring 225 is provided to bias actuator 200 away from second electrical contact 215. In an alternative embodiment, rather than pivoting, actuator 200 can be configured to translate in a direction substantially perpendicular to liner 110. In addition, one skilled in the art will recognize that other switching arrangements can be used in place of first electrical contact 210 and second electrical contact 215.

As actuator 200 is moved from the first position to the second position by fresh food door 120, movement of actuator 200 is dampened and, as a result, movement of fresh food door 120 is also dampened (i.e., the energy of fresh food door 120 is absorbed to thereby slow movement of fresh food door 120). A damper 230, which is preferably a hydraulic or pneumatic damper, provides this dampening effect. In particular, damper 230 includes a piston cylinder 235, a piston rod 240 and a piston 245. Piston rod 240 contacts or is coupled to actuator 200. Accordingly, pivotal movement of actuator 200 results in piston rod 240 translating within piston cylinder 235 in a direction perpendicular to liner 110. Since this translational motion is damped as fluid is regulated across piston 245, the pivotal movement of actuator 200 is also dampened, which, in turn, dampens motion of fresh food door 120 when fresh food door 120 is in contact with actuator 200. In addition to biasing actuator 200, spring 225 also helps damper 230 move back to its extended position after fresh food door 120 is opened.

In the embodiment shown in FIG. 2, switch 180 also includes a housing 250 with a front wall 255, a rear wall 260 and sidewalls 265 and 266. However, switch 180 can be made up of multiple housings or have no housing at all. Actuator 200 is coupled to front wall 255 by hinge 205 such that actuator pivots relative to housing 250. Similarly, second electrical contact 215 is exposed at front wall 255 so that first electrical contact 210 can touch second electrical contact 215 when actuator 200 is pivoted to the second position. Housing 250 is shown divided, along a plane substantially perpendicular to liner 110, into a switch portion 270 and a damper portion 275. This division also results in actuator 200 having a first end 280 in damper portion 275 and a second end 285 in switch portion 270. Switch portion 270 includes at least first electric contact 210 and second electrical contact 215, while damper portion 275 includes at least piston cylinder 235, piston rod 240 and piston 245. In this embodiment, switch portion 270 and damper portion 275 (along with their constituent parts) are located adjacent to one another in a side-by-side arrangement, with spring 225 being interposed there between. Specifically, a side-by-side arrangement is defined as an arrangement in which switch portion 270 and damper portion 275 are located next to one another or are laterally offset from one another when a user looks at the surface to which switch 180 is mounted (e.g., liner 110). Switch portion 270 and damper portion 275 can also be arranged one above the other, with such an arrangement constituting a "side-by-side" arrangement for the purposes of the present invention. This vertical side-by-side arrangement is advantageous when switch 180 is provided in location 191 with switch 180 rotated 90 degrees counterclockwise, for example.

Although switch 180 has been described as a door-ajar switch having a damper, switch 180 is actually part of a combined door-ajar and damper system. Such a system is defined as including an indicator configured to indicate a door-ajar condition (e.g., indicator 185), a door-ajar switch (e.g., first electrical contact 210 and second electrical contact 215) and a damper (e.g., damper 230 and, more specifically, piston cylinder 235, piston rod 240 and piston 245). Also, while switch 180 is shown mounted to liner 110, switch 180 can be mounted to another surface. For example, when switch 180 is provided at location 191, switch is mounted to user interface 155 rather than liner 110. Similarly, the door-ajar switch of the present invention can be used elsewhere in a refrigerator (e.g., in a freezer compartment), in another type of appliance or anywhere such switches are typically used.

Figure 3A:
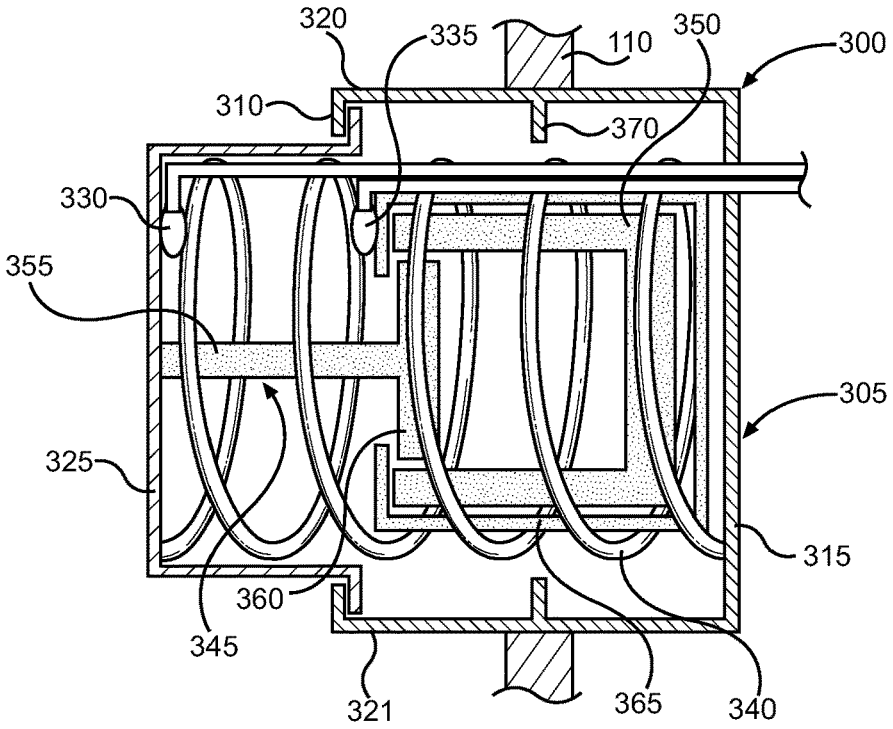
FIG. 3A is a cross section of a portion of the refrigerator showing a combined door-ajar switch and damper of a second embodiment in an open position.
Figure 3B:
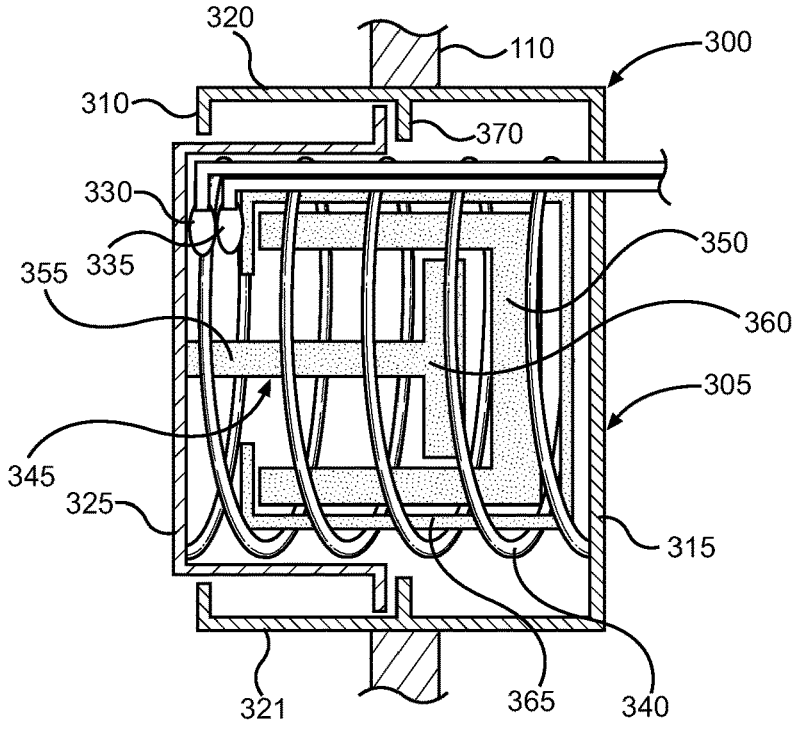
FIG. 3B shows the combined door-ajar switch and damper of the second embodiment in a closed position.

With reference to FIGS. 3A and 3B, there is illustrated a cross section of a portion of refrigerator liner 110 showing a switch 300 from a top-down perspective. In contrast to switch 180 where switch portion 270 and damper portion 275 are arranged along parallel axes, the switch and damper portions of switch 300 are arranged along the same axis. Otherwise, switch 300 functions in a substantially similar manner to switch 180 and, accordingly, will not be described in as great detail. As with switch 180, switch 300 includes a housing 305 having a front wall 310, a rear wall 315 and sidewalls 320 and 321. An actuator 325 moves relative to housing 305 (and, more specifically, translates relative to housing 305) between a first, extended position, shown in FIG. 3A and a second, compressed position, shown in FIG. 3B. In the first position, a first electrical contact 330 is spaced from a second electrical contact 335 such that switch 300 is open. Actuator 325 is biased to the first position by a spring 340. As fresh food door 120 forces actuator 325 to the second position, the motion of actuator 325 and fresh food door 120 is damped by a damper 345. Damper 345 includes a piston cylinder 350, piston rod 355 and piston 360. As illustrated, damper 345 is partially enclosed by an inner housing 365, with second electrical contact 335 coupled to inner housing 365. However, in an alternative embodiment, piston cylinder 350 can be fixed to some portion of housing 305, with second electrical contact 335 coupled to piston cylinder 350. Additionally, second electrical contact 335 can be coupled to housing 305, either elsewhere within housing 305 or to some exterior portion of housing 305. In any case, movement of actuator 325 to the second position causes first electrical contact 330 to contact second electrical contact 335, thereby closing switch 300. Movement of actuator 325 relative to housing 305 is limited by front wall 310 and projections (one of which is labeled 370).

Based on the above, it should be readily apparent that the present invention advantageously provides for a combined door-ajar and damping system which is integrated into a common or integral unit in order to provide, through the use of a single actuator, for signaling to a user when an associated door is ajar and also dampening movement of the door to protect again an undesired sudden shifting of items supported on the door. In any case, although described with reference to preferred embodiments, it should be readily understood that various changes or modifications could be made to the invention without departing from the spirit thereof. In general, the invention is only intended to be limited by the scope of the following claims.

The invention claimed is:

1. A refrigerator comprising:

a cabinet including a liner that defines a refrigerated compartment;

a door configured to selectively seal the refrigerated compartment, the door being movable between an open position, wherein food items stored in the refrigerated compartment can be accessed, and a fully closed position, wherein the door extends across and seals the refrigerated compartment;

an indicator configured to indicate a door-ajar condition; and a door-ajar switch for activating the indicator, said door ajar switch including:

an actuator configured to move between a first position, when not contacted by the door, and a second position, when contacted by the door and the door is in the fully closed position;

a spring configured to bias the actuator to the first position;

a switch portion; and a fluid damper portion, wherein the switch portion and the damper portion are located adjacent to one another in a common housing mounted to the cabinet or the door.

2. The refrigerator of claim 1, wherein the switch portion includes a first electrical contact and a second electrical contact, and the damper portion includes a piston movable within a piston cylinder.

3. The refrigerator of claim 1, wherein the damper portion includes a damper that contacts or is coupled to the actuator such that movement of the door between the open position and the fully closed position is dampened while the door is in contact with the actuator.

4. The refrigerator of claim 3, wherein the damper includes a piston rod, and wherein the piston rod contacts or is coupled to the actuator such that movement of the door between the open position and the fully closed position is dampened while the door is in contact with the actuator.

5. The refrigerator of claim 1, wherein the actuator is configured to open or close the door-ajar switch when the actuator moves between the first and second positions.

6. The refrigerator of claim 5, wherein:

the switch portion has a first electrical contact and a second electrical contact, the first electrical contact being coupled to the actuator;

the first and second electrical contacts are not in contact when the actuator is in one of the first and second positions, thereby opening the door-ajar switch; and the first and second electrical contacts are in contact when the actuator is in the other of the first and second positions, thereby closing the door-ajar switch.

7. The refrigerator of claim 1, wherein the switch portion and the damper portion are located in a side-by-side arrangement within the housing.

8. The refrigerator of claim 7, wherein the actuator is configured to pivot between the first and second positions.

9. The refrigerator of claim 8, wherein:

the actuator has a first end proximate to a pivot axis of the actuator and a second end distal to the pivot axis;

the damper portion has a damper that contacts or is coupled to one of the first and second ends of the actuator; and another of the first and second ends of the actuator is configured to open or close the door-ajar switch when the actuator is pivoted between the first and second positions.

10. The refrigerator of claim 7, wherein the housing has two sidewalls, the switch portion is located proximate one of the sidewalls and the damper portion is located proximate the other of the sidewalls.

11. The refrigerator of claim 10, wherein the spring is interposed between the switch portion and the damper portion within the housing.

12. The refrigerator of claim 1, wherein the damper portion includes a piston cylinder located within the housing, and the switch portion includes a first electrical contact coupled to the housing or located within the housing.

13. The refrigerator of claim 12, wherein:

the actuator is movable relative to the housing;

the actuator has a second electrical contact; and the first and second electrical contacts are brought into or out of contact as the door is moved to the fully closed position.

14. A method of operating a refrigerator including: a cabinet having a liner that defines a refrigerated compartment; a door configured to selectively seal the refrigerated compartment, the door being movable between an open position, wherein food items stored in the refrigerated compartment can be accessed, and a fully closed position, wherein the door extends across and seals the refrigerated compartment; and a door-ajar switch having a switch portion and a fluid damper portion, the switch portion and the damper portion being located adjacent to one another in a common housing mounted to the cabinet or the door, the method comprising:

moving an actuator, which forms part of each of the switch portion and the damper portion of the door-ajar switch, between first and second positions by moving the door between the open and fully closed positions;

biasing the actuator to the first position with a spring;

sensing when the door is ajar based on a condition of the door-ajar switch and activating an indicator when the door is ajar for a predetermined period of time; and dampening movement of the door between the open position and the fully closed position with the damper portion.

15. The method of claim 14, wherein moving the actuator between the first and second positions opens and closes the door-ajar switch and shifts the damper portion to dampen movement of the door.

16. The method of claim 15, wherein the switch portion and the damper portion are located in a side-by-side arrangement, and wherein moving the actuator from the first position to the second position includes pivoting the actuator.

17. The method of claim 16, wherein biasing the actuator to the first position with the spring includes biasing the actuator to open the switch portion with the spring, the spring being interposed between the switch portion and the damper portion.

* * * * *